United States Patent [19]

Hanke et al.

[11] Patent Number: 4,661,244

[45] Date of Patent: Apr. 28, 1987

[54] ROTARY BASKET AIR CLASSIFIER

[75] Inventors: Ernst W. Hanke; Benno Bonk; Erwin Schmitz, all of Beckum, Fed. Rep. of Germany

[73] Assignee: Firma Christian Pfeiffer, Beckum, Fed. Rep. of Germany

[21] Appl. No.: 748,352

[22] Filed: Jun. 24, 1985

[30] Foreign Application Priority Data

Apr. 25, 1985 [DE] Fed. Rep. of Germany ..... 3515026

[51] Int. Cl.[4] ..... B07B 7/083

[52] U.S. Cl. ..... 209/139.2; 209/144; 209/148; 209/154

[58] Field of Search ..... 209/138, 139 R, 139 A, 209/140, 141, 144, 154, 148

[56] References Cited

U.S. PATENT DOCUMENTS

| | | | |
|---|---|---|---|
| 3,015,393 | 1/1962 | Rozsa et al. | 209/144 |
| 3,524,544 | 8/1970 | Jäger | 209/139.2 |
| 3,656,618 | 4/1972 | Janich | 209/139.2 |
| 3,807,552 | 4/1974 | Gotthard | 209/139.2 X |
| 4,152,254 | 5/1979 | Steier et al. | 209/148 |
| 4,211,641 | 7/1980 | Jäger | 209/144 |
| 4,296,864 | 9/1981 | Misaka et al. | 209/154 X |
| 4,388,183 | 6/1983 | Thomas | 209/139 A |
| 4,390,419 | 6/1983 | Barthelness | 209/144 X |
| 4,515,686 | 5/1985 | Jarich | 209/139 A |
| 4,551,241 | 11/1985 | Sauerse et al. | 209/144 X |

FOREIGN PATENT DOCUMENTS

| | | | |
|---|---|---|---|
| 0067894 | 12/1982 | European Pat. Off. . | |
| 0023320 | 3/1984 | European Pat. Off. . | |
| 1507729 | 3/1972 | Fed. Rep. of Germany | 209/139 A |
| 3411785 | 10/1984 | Fed. Rep. of Germany | 209/144 |
| 288912 | 2/1971 | U.S.S.R. | 209/154 |

OTHER PUBLICATIONS

Zement-Kalk-Gips, vol. 38, No. 1/85, "Neue Erkenntnisse zur Sichtergestaltung", by F. Sgaslik. (with partial translation).

*Primary Examiner*—S. Leon Bashore
*Assistant Examiner*—Thomas M. Lithgow
*Attorney, Agent, or Firm*—Fleit, Jacobson, Cohn & Price

[57] ABSTRACT

The invention relates to a rotary basket air classifier. A favorable predispersion of the material to be classified, particularly in the case of an upwardly directed spent classifying air line has always been problemmatical with such classifiers. According to the invention, the material to be classified is distributed over several stages, aided by dispersing blades and a higher drawing-off capacity of the spent classifying air is permitted by the branching of the drawing-off line.

14 Claims, 4 Drawing Figures

ROTARY BASKET AIR CLASSIFIER

BACKGROUND OF THE INVENTION

The present invention relates to a rotary basket air classifier.

Such a classifier or separator is known from EP No. 67,894 A 1. Such classifiers generally require dust separators, e.g. in the form of cyclones for separating the fine material particles from the classifying air. It can be appropriate for this purpose to remove the classifying air from the classifier as near as possible to the top, so that there is sufficient space for erecting the subsequently connected cyclone and the recirculating air blower which produces the classifying air. This is particularly important where the classifier is connected downstream of a mill and, to reduce costs, the classifier is to be as closely superimposed on the mill as possible.

This removal of the spent classifying air coaxially to the classifier rotation axis and as centrally as possible to the basket leads to important problems with respect to an optimum predispersion of the material to be classified. However, a particularly good predispersion is the prerequisite for an excellent selectivity during the classifying process. In other words, in an optimum-operating classifier, it is desirable that with a sought separation gain boundary as little oversize material as possible passes into the fines and simultaneously a minimum amount of undersize material passes into the coarse material. The particle mixture to be classified must therefore enter the classifying chamber in as uniformly as possible a distributed manner, whilst obviously preventing a dropping down of the particle mixture into the classifying chamber or counter to the whirling classifying air.

However, this necessary predispersion is not ensured in the case of a classifier known from EP No. 67,894 A 1, because around the upwardly directed suction line therein is provided a ring main for feeding in the particle mixture or raw material which is positioned directly above the classifying chamber, so that it can be assumed that the particle mixture to be classified in principle merely drops into the classifying chamber and even a classifying material entry counter to the whirling classifying air cannot be excluded.

In the case of another classifier known from EP No. 23,320 B 1, an attempt is made to obtain a scattering or strewing action for the introduced raw material or particle mixture in the case of a coaxially upwardly directed suction line for the fines-laden classifying air. However, a good dispersing action is not obtained, because in said known classifier merely the outer, flange-like edge of the upper termination of the basket can be used for a mechanical strewing means. In this known classifier, the particle mixture also drops substantially in punctiform manner through two or more inlets arranged around the central suction line onto the flange-like edge rotating at a relatively high circumferential speed. Each of the corresponding impact points radially accelerates the individual particles of the screening material in an immediate manner and in the case of a limited drag only a triangular strewing mist can form, which can be interrupted by adjacent strewing mists. The further disadvantage exists in this known classifier that in the case of varying speeds of the basket relative to varying separating particle boundaries, the shape and spacings of the strewing mists can change, so that it is not possible to obtain a uniform distribution of the material to be classified. The lack of a central classifying material feed, linked with the non-uniform distribution action of the flange-like edge, has a particularly unfavourable effect on the sought optimum dispersing process.

As a good predispersion helps significantly to determine the throughput capacities for the material to be classified, this being of particular importance in the case of a preceding grinding in the closed grinding material circuit, as quantity fluctuations there can have a sudden effect on the classifying process, the prior art constantly attempts to obtain a good predispersion.

Thus, e.g. a PSZ spiral air classifier is known (Zement-Kalk-Gips, Vol. 38, no. 1/85 "Neue Erkenntnisse zur Sichtergestaltung", by F. Sgaslik, FIG. 7) in which a predispersion of the material to be classified is sought. The material to be classified is fed centrally into this PSZ classifier and is strewn by a sloping, rotating strewing plate or disk into a downwardly widened, conical distribution gap. Admittedly, the uniformity of the classifying material distribution improves with increasing diameter. However, experience has shown that the angle of inclination of this distribution gap surrounding the classifying chamber is dependent on the friction coefficients of the friable or trickling particle mixture. In the case of an optimum classifying material distribution by trickling, the particle mixture must not drop and must instead just be able to slide, i.e. it must be flowable. In addition, the trickling path must be long enough to achieve the desired predispersion. In order in the case of this known PSZ classifier to obtain a wide region for varyingly friable classifying material the complicated procedure is used therein of blowing scavenging air into the conical distribution gap. Moreover, in the case of this known PSZ classifier the problem occurs that it is necessary to accept a large horizontal component for a sufficiently long trickling path, the flow-correct distance from the basket to the angular momentum-producing guide vanes being exceeded and consequently the circular classifying chamber is enlarged. The resulting limited curvature of the necessary classifying air spirals in the classifying chamber makes it necessary to operate with higher classifying air velocities for maintaining the same classifying effect. However, this means that for larger air quantities correspondingly larger deposition means, such as cyclone separators or filters are required, which considerably increase equipment costs.

SUMMARY OF THE INVENTION

On the basis of this prior art, the problem of the present invention is to construct a rotary basket air classifier in such a way that even in the case of increased throughput capacities of the particle mixture to be classified, a good predispersion is obtained, this optionally also being possible in the case of a centrally upwardly exiting suction line for the fines-laden spent classifying air.

An essential concept of the invention for improving classifying and the throughput capacity with a more favourable overall height of the classifier comprises having a substantially central infeed of the particle mixture to be classified onto a first strewing plate or disk, at least one further strewing stage being positioned downstream thereof. In addition to said strewing disk, in the area prior to the intake of the particle mixture, dispersing blades are provided in the classifying chamber and lead to a further improvement in making the strewing in of the classifying material into the following classifying chamber more uniform. Compared with the preceding stage, the surfaces of the individual hopper casings are made larger in the direction of the classifying chamber, in order to thin and make more uniform the strewing mist. Since specifically in the case of an upwardly directed suction line for the spent classifying air and fine material, flow and distribution discontinuities can occur in the dispersing process of the introduced particle mixture, in the invention the suction line is preferably subdivided below the first strewing disk into several, and specifically two, flow-symmetrical spent classifying air outlets. The several stages of strewing disks and hopper casings compensate any discontinuities. However, as a result of the plurality of spent classifying air outlets a higher suction capacity and also the connection of several cyclones are made possible. Thus, the concept according to the invention makes it possible, even in the case of a high feed capacity and high suction capacity to obtain a space-saving classifier design with respect to its overall height and diameter, this being obtained with a substantially optimum dispersion of the particle mixture to be classified. In order to be able to largely control the classifier parameters which influence dispersion and classification, the strewing disks, dispersing blades and basket or extractor bucket are preferably designed so as to be separately drivable. This permits both an identical rotation of said means and also a relatively different rotation. The rotation direction of said means takes place in such a way that the classifying material flows in the same rotation direction into the classifying air spirals circulating in the classifying chamber.

In the invention, the upwardly exiting suction line is also not an obstacle to providing a further, specifically circular strewing disk in said area. On this stage, the second strewing disk is combined with a tubular, upwardly projecting circumferential wall, which coaxially surrounds the fixed suction line, said circumferential wall projecting axially upwards into the opening hopper of the first hopper casing. In the case of an adequately small spacing between said circumferential wall and the suction line, an existing narrow annular clearance remains without impairing the suction capacity of the connected cyclones. This small annular clearance can also be kept fluid-tight by a seal permitting the rotation of the strewing disk with its circumferential wall.

In order to obtain an even more compact classifier with respect to its overall height, according to the invention where the external units permit, the suction line passes downwards from the basket. Thus, it is possible to design the first hopper casing stage much smaller axially, without impairing the dispersion of the particle mixture to be distributed. In the case of a suction line on one side, it is possible to largely eliminate the varying suction actions in the basket partly existing in the prior art, in that the guide vanes are axially subdivided and are also angularly adjustable relative to one another. Thus, the spirally inflowing classifying air can be provided on the suction side with a different inflow path and whirling action as compared with that in the region of the opposite and generally largely closed plate of the basket.

If the single-stage classification is to be additionally improved, in the vicinity of the coarse material outlet adjacent to the lower area of the basket, it is possible to provide a further classifying air inlet with corresponding guide vanes. In order that the external units can be maintained as uncomplicated as possible, said second classifying air inlet can be designed in the manner of a bypass or a branch from the main classifying air inlet.

In the case of a funnel-shaped configuration of the strewing disk with upwardly projecting opening surfaces, there is an improvement to the strewing of the particle mixture falling thereonto, because through the inclination of the strewing disk and the weight of the individual particles, a uniform movement of the particle sizes to the strewing disk edge is achieved.

As the invention permits both an upwardly directed and a downwardly directed suction line, to improve the flow conditions within the basket, it is advantageously possible to provide a coaxial suction line on either side of said basket. This has the advantage that there is no need for the normally necessary additional, fixed or non-rotary screen casings within the rotary basket. As a result, the basket flow blades constructed as ledges or vanes can be radially stiffened so that it saves weight and material. This permits a reduced moment of inertia as a result of the reduced mass, making the interchangeable wear protection easier to handle.

BRIEF DESCRIPTION OF THE DRAWINGS

The invention is described in greater detail hereinafter relative to two non-limitative embodiments and the attached drawings, which show.

DETAILED DESCRIPTION OF THE PREFERRED EMBODIMENTS

As rotary basket air classifiers and their operation are adequately known, reference is made hereinafter largely to the differences compared with the known classifiers.

Figure 1:
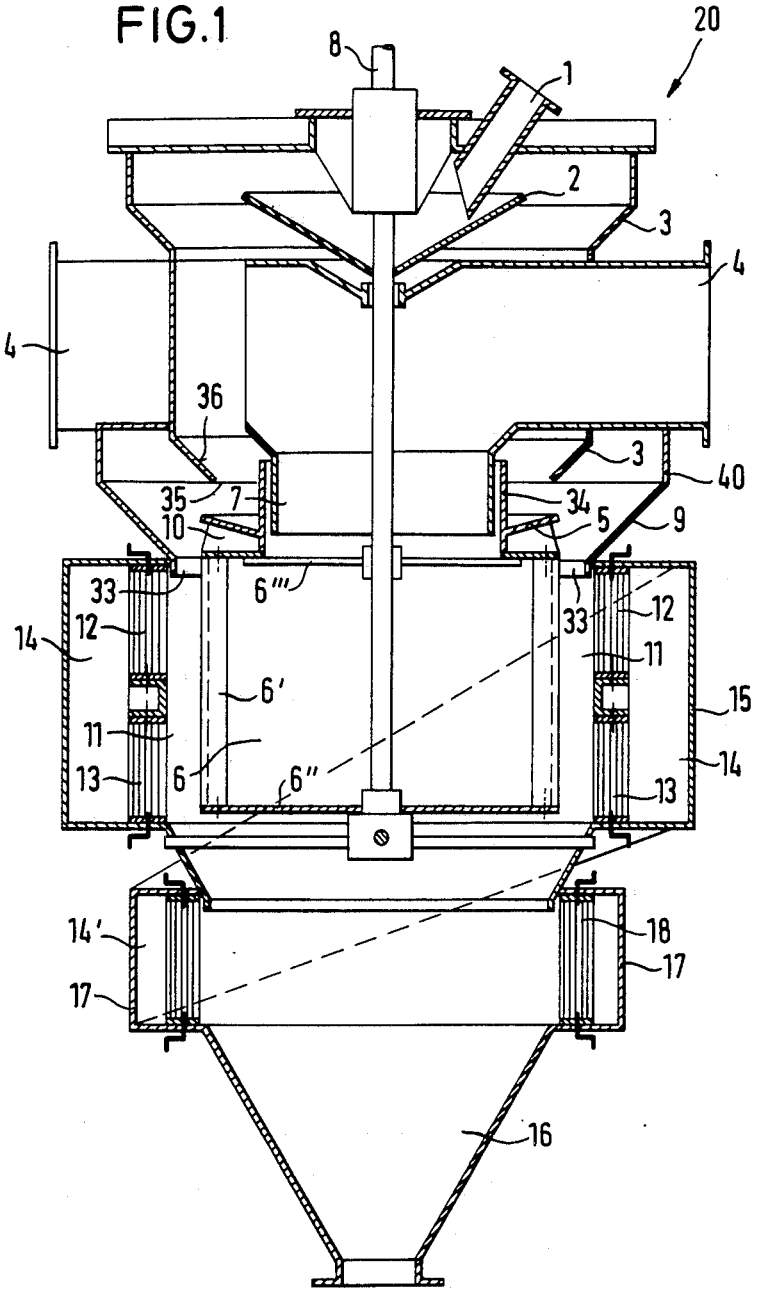
FIG. 1—a first embodiment of a rotary basket air classifier substantially in axial section, in which the spent classifying air is sucked centrally upwards out of the basket.
Figure 2:
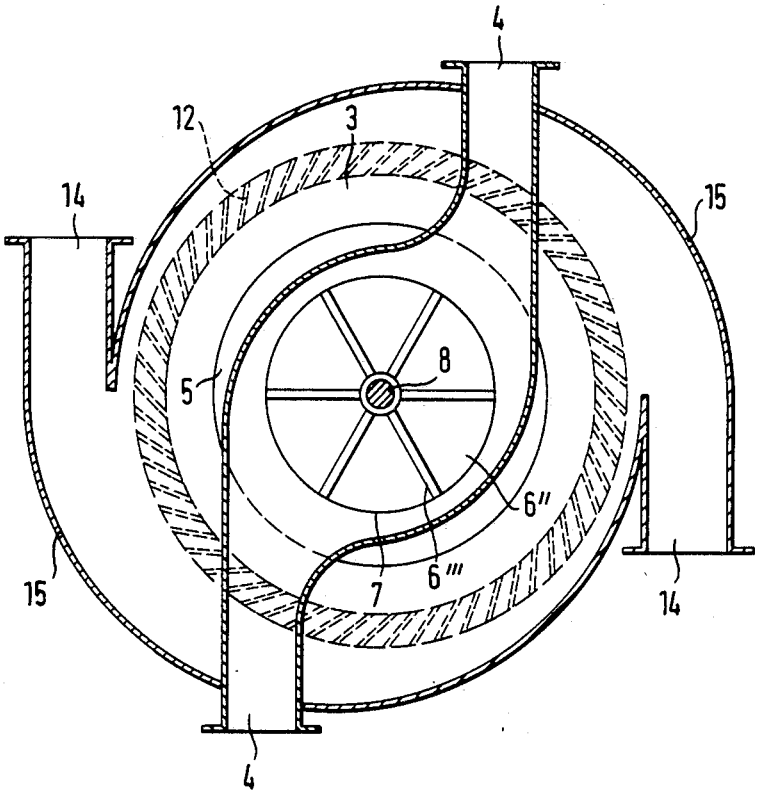
FIG. 2—a diagrammatic radial section through the classifier according to FIG. 1 showing both the configuration of the spent classifying air connection and the spiral classifier casing on the plane of the classifying air inlets.

FIGS. 1 and 2 relate to a classifier, in which the spent classifying air is sucked upwards. The vertically operated classifier 20 e.g. has a central shaft 8 for driving an upper, first strewing disk 2, as well as a following second strewing disk 5 below it, dispersing blades 10 associated therewith and a basket 6. The material to be classified or particle mixture passes through the intake connection 1 substantially centrally into the classifier 20. In the present case, there is a single intake connection 1, which supplies the particle mixture in inclined manner to the hopper opening of the strewing disk 2 in the inner cone thereof. The first rotating strewing disk 2 hurls the introduced particle quantity against a hopper casing 3 which radially surrounds said disk 2. In a special construction, said hopper casing 3 comprises two conically tapering casing areas connected to a substantially vertically directed circumferential wall through which a spent classifying air connection 4 is led downwards on opposite sides of the classifier 20.

This vertical casing area of the first hopper casing 3 contributes to achieving a substantially uniform distribution of the introduced particle mixture, despite passing through the spent classifying air connection 4. If higher suction capacities for the classifying process are desired, in place of the presently shown two diametrically facing, outwardly led spent classifying air connections, it is possible to provide several, e.g. three or four such connections with the same reciprocal angular spacing.

From the upper stage of the hopper casing 3 the particle mixture to be so classified is passed spirally downwards into a tapering opening forming a mouth area 35. Strands of the sliding mist of material to be classified, which can form in the case of very small introduced particle mixture quantities as a result of the passage through the spent classifying air connections, are largely eliminated and the particle mixture is largely uniformly collected.

From the tapering opening 36 of the hopper casing 3, the particle mixture to be classified slides in predistributed manner into the second rotary strewing disk 5 which is substantially circular and has on its radially inner end a tubular circumferential wall 34 projecting upwards above the mouth area 35 of the first hopper casing 3. This circumferential wall 34 surrounds a downwardly open, central spent classifying air tube 7, which is upwardly branched in the vicinity of the vertical circumferential wall of hopper casing 3 into two spent classifying air connections 4.

Onto the strewing disk 5 forming a partial hopper opening to the top is connected at the bottom approximately radial dispersing blades 10, which e.g. are connected in rotary rigid manner with the second strewing disk 5 and the basket 6 arranged below it.

The second strewing disk 5 is surrounded radially outwards by a second hopper casing 9, which has a larger diameter than the first hopper casing 3. The second strewing disk 5 hurls the particle mixture to be classified against the second hopper casing 9, on whose circumference there is a complete circular distribution of the particle mixture to be classified. Dispersing blades 10 are provided for producing air eddies to enable the already largely uniformly predistributed particle mixture to flow in an optimally predispersed manner into the classifying chamber 11 positioned below the same.

In place of the rotation-rigid linkage between the strewing disks 2, 5 as, well as the dispersing blades 10 and the basket 6, it is also possible to provide separate rotary drives, e.g. by means of hollow shafts, for these individual subassemblies.

The substantially cylindrical basket 6 has towards the bottom a relatively thin, closed plate 6''. Radially outwards, the basket 6 has a ring of flow blades 6', which are arranged in a substantially axially parallel manner and which can e.g. be constructed as ledges, vanes, etc. Basket 6 is open at its upper end over most of its diameter, e.g. over $\frac{2}{3}$ and more of its diameter, in order to form a large suction opening in the direction of the central spent classifying air tube 7. For stability reasons, this open part of the basket 6 is equipped with a small number of radial spokes 6''', which are fixed to shaft 8 and below the dispersing blades, e.g. are materially welded. Whilst taking account of their rotation direction, said spokes 6''' can be given a cross-sectionally flow-favourable form, so that the suction flow acting into the basket 6 is largely uninfluenced by them.

The classifying chamber 11 is connected radially outwards at least over the entire axial height of the basket 6, and optionally even to the bottom, and it is bounded radially outwards by guide vane rings 12, 13.

In the present embodiment, the guide vanes are axially subdivided and split up into two individual guide vane rings 12, 13, each of which is separately angularly adjustable. There is only a double subdivision in the embodiment for simplification reasons. The nature of the air movements circulating in the classifying chamber 11 can be adjusted by means of these independently adjustable guide vane rings 12, 13. Particularly in the case of a suction line on one side, the suction acting on the fines can be adjusted independently of the axial height in the classifying chamber and at least partly extending into the basket.

As can be seen from FIG. 2, the classifying air blown through the classifying air intakes 14 flows through the spiral casing 15 in a narrowing spiral path. The blown-in classifying air is introduced into the classifying chamber 11 with a corresponding flow and whirling direction via the sloping guide vane rings 12, 13. The particle mixture introduced in predispersed manner into the classifying chamber 11 through the intake gap 33 on the lower opening of the second hopper casing 9 is classified here in accordance with the set particle boundary size, which is dependent on a number of parameters, such as e.g. the speed of basket 6, the throughput capacity, the degree of predispersion, the setting of the guide vane limit, the blowing-in and drawing-off speeds of the classifying air, etc. The fines-laden classifying air flows radially inwards through the flow blades 6' of the basket 6 and subsequently distributed by the central spent classifying air tube 7 is sucked off at the two classifying air connections 4. The following separators and cyclones for separating the fines from the spent classifying air are not shown.

In the case of the classifier 20 according to FIG. 1, at the bottom is connected the coarse material hopper 16, via which is discharged the material above the particle limit size. In order to be able to carry out reclassification, following a short funnel-shaped transition zone, a further spiral casing 17 is connected at the bottom and is also provided with an adjustable guide vane ring 18. Thus, in this area, there is a reclassification of the downwardly falling particle mixture. The secondary classifying air intake 14' in spiral casing 17 is consequently appropriately connected to the primary classifying air intake 14, so that a regulatable proportion of classifying air can be blown in there for reclassification purposes.

As a function of the intended use, the flow blades 6' of basket 6 can have different profiles and can differ by their radial extension. The inventive matching of the subassemblies is important, so that even in the case of a suction line on one side, the suction action is substantially uniformly set over the axial height of the basket.

The sectional representation of FIG. 2 makes it clear that a radially widened classifying air guidance in the vicinity of the classifying air intake produces a constriction in a range of 180° after the classifying air enters through the spiral casing 15. The transition areas from the central spent classifying air tube 7 to the spent classifying air connection 4 are designed in accordance with the flow direction produced by the classifier. The removal of the fines-laden classifying air in the embodiment takes place with a displacement of the classifying air connection of 90° to 180° with respect to the opening of the classifying air intakes 14.

Figure 3:
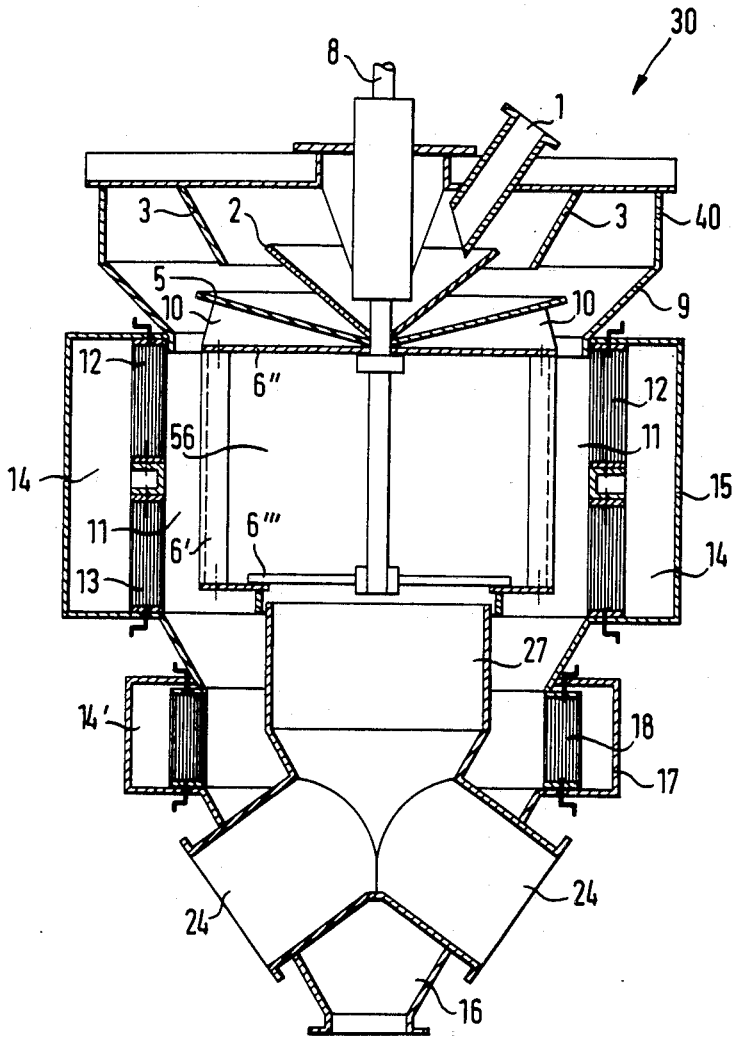
FIG. 3—a second embodiment of a rotary basket air classifier substantially in axial section, in which the spent classifying air is sucked centrally downwards out of the basket.
Figure 4:
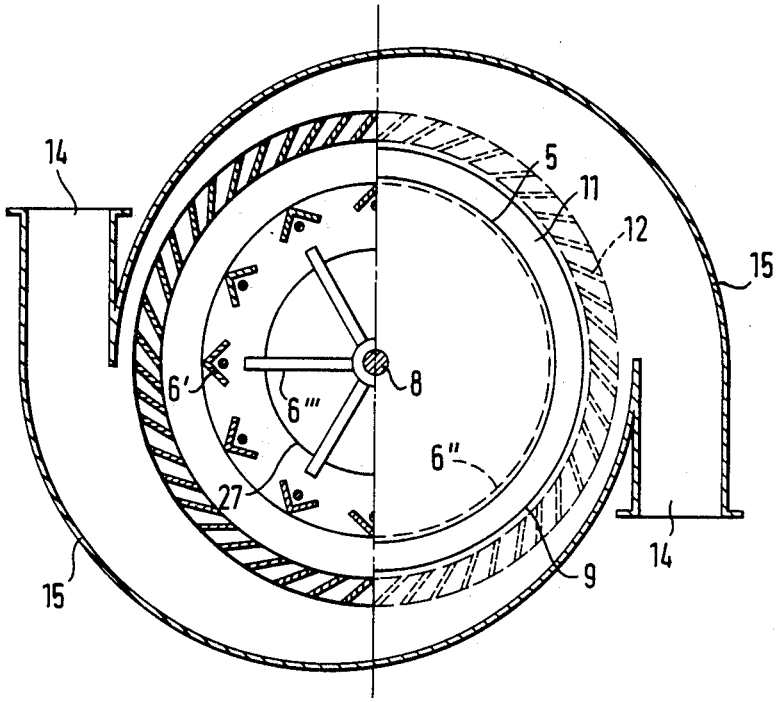
FIG. 4—two radial sections through the classifier according to FIG. 3 in different planes, in which to the left a section in the vicinity of the guide vanes is shown in a plan view downwards and in the right-hand part a plan view of the closed plate closing the basket at the top.

FIGS. 3 and 4 show a classifier 30, whose central spent classifying air tube 27 is located below the basket 56. In the case of functionally coinciding subassemblies, the same reference numerals are used as in the first embodiment according to FIGS. 1 and 2, the operation of classifier 30 also being substantially the same, apart from the removal direction.

The basket 56 of classifier 30 is constructed in axially inverted manner, so that the closed plate 6'' is at the top, whilst the spokes 6''' for reinforcing the basket 56 are positioned at the bottom.

The important advantage of classifier 30 is that there is a central charging of the particle mixture to be classified, it being possible to significantly reduce the axial extension of the complete classifier by the elimination of an upper spent classifying air line and the corresponding connection. In particular, in the case of classifier 30, the first distribution of the material to be classified can be performed via a conical hopper casing 3 with a single stage. Thus, strewing disks 2, 5 can be fixed to the shaft in a substantially punctiform manner.

A downwardly guided spent classifying air tube 27 is centrally connected to the bottom-open basket 56. This tube is conically tapered somewhat in the reclassification area and then issues in the vicinity of the coarse material hopper 16 as two spent classifying air connections guided outwards at an inclination angle to the axis of classifier 30. The downward suction of the spent classifying air also leads to the advantage that any strand-type classifying material mists are excluded from the outset.

The left-hand half of FIG. 4 shows an exemplified profile of the flow blades 6' and in this case they are constructed as isosceles triangles, whose apex points radially outwards. A symmetrical arrangement with respect to the radius is sought. A modification of the angle in the axial height is also appropriate so that in the case of one-sided spent classifying air suction, a substantially uniform suction is ensured over the entire axial height of the basket 56.

In the right-hand half of FIG. 4, it is possible radially inwards to see the closed plate 6'', to which is connected the entry gap 33 or the circular-cylindrical classifying chamber 11 positioned below it.

What is claimed is:

1. A rotary basket air classifier, said classifier comprising: a housing defining a vertical axis, a substantially cylindrical basket coaxially mounted in said housing having circumferentally positioned axially extending flow blades through which a classifying air flow substantially flows from outside the basket to the inside and a closed plate at one end of said cylindrical basket; drive means for rotating said basket about said vertical axis; a coaxial ring of guide vanes in said housing radially outward outward of said basket defining an annular classifying chamber there between; said housing comprising first inlet means for enabling classifying air to enter into said classifying chamber with a spiral whirling action past said guide vanes; said housing defining an inlet opening above said classifying chamber for feeding a particle mixture of coarse and fine material into said housing to be classified; said housing futher comprising outlet means below said classifying chamber for said coarse material fine material outlet means for fine material laden spent classifying air, said fine material outlet means extending coaxially with respect to the end of the basket opposite said closed plate; a first rotary strewing disk rotatably mounted in said housing about said vertical axis and positioned to receive said particle mixture being fed through said inlet opening; said housing further comprising a first hopper casing means surrounding said first strewing disk and radially outwardly spaced therefrom having an inwardly tapering outlet means defining an opening for feeding said mixture to a second rotary strewing disk; said second rotary strewing disk rotatably mounted about said vertical axis and positioned below said first strewing disk; said housing further comprising a second hopper casing means surrounding said second strewing disk and radially outwardly spaced therefrom and having a larger diameter than said first hopper casing means, said second hopper casing means having inwardly tapering outlet means which in combination with the top of said cylindrial basket defines in entrance gap for enabling said particle mixture to feed into said classifying chamber; a plurality of rotary dispersing blades rotatably mounted about said vertical axis adjacent said entrance gap; and said fine material outlet means comprising several flow-symmetrical spent classifying air outlet means.

2. A classifier according to claim 1, wherein said fine material outlet means extend vertically upward from said basket to said plurality of spent classifying air outlet means, said air outlet means positioned below said first strewing disk and extending circumferentially outwardly from the classifier housing.

3. A classifier according to claim 1, wherein said fine material outlet means extends vertically upward from said basket to said plurality of spent classifying air outlet means, said air outlets positioned below said first strewing disk and extending substantially at right angles to the rotation axis.

4. A classifier according to claim 1, wherein said second strewing disk is constructed in an approximately circular manner and has an upwardly extending circumferential wall coaxially surrounding a portion of said fine material outlet means and projecting axially upwardly above said opening defined by the first hopper casing outlet means.

5. A classifier according to claim 1, wherein the fine material outlet means is positioned below and adjacent the bottom end of said basket.

6. A classifier according to claim 1, wherein said closed plate end of the basket is the bottom end of the basket.

7. A classifier according to claim 1, wherein said second strewing disk is connected to said drive means for rotation with said basket.

8. A classifier according to claim 1, wherein said dispersing blades are connected to said drive means for rotation with said basket.

9. A classifier according to claim 1, wherein said strewing disks, said dispersing blades and said basket are each connected to said drive means for rotation at the same speed.

10. A classifier according to claim 1, wherein said guide vanes include first and second guide vanes positioned axially adjacent each other and said first and second guide vanes are angularly adjustable relative to one another.

11. A classifier according to claim 1, wherein said housing further comprises, second air inlet means provided below said classifying chamber and above said coarse material outlet means for reclassification of said coarse material, said second air inlet means from said first air inlet means.

12. A classifier according to claim 1, wherein said strewing disks are substantially conical and include upwardly open conical surfaces.

13. A classifier according to claim 11, wherein said second air inlet means includes a spiral casing, said spiral casing including adjustable guide vane ring means for controlling whirling of air interiorly of said second air inlet means to provide reclassification of the coarse material.

14. A rotary basket air classifier, said classifier comprising: a housing defining a vertical axis having circumferentially positioned axially extending flow blades through which a classifying air flow substantially flows from outside the basket to the inside and a closed plate at one end of said cylindrical basket; drive means for rotating said basket about said vertical axis; a coaxial ring of guide vanes in said housing radially outward of said basket defining an annular classifying chamber there between; said housing comprising first inlet means for enabling classifying air to enter into said classifying chamber with a spiral whirling action past said guide vanes; said housing defining an inlet opening above said classifying chamber for feeding a particle mixture of coarse and fine material into said housing to be classified; said housing further comprising outlet means below said classifying chamber for said coarse material fine material outlet means for fine material laden spent classifying air, said fine material outlet means extending coaxially with respect to the end of the basket opposite said closed plate and comprising several flow-symmetrical spent classifying air outlet means; a first rotary strewing disk rotatably mounted in said housing about said vertical axis and positioned to receive said particle mixture being fed through said inlet opening; said housing further comprising a first hopper casing means surrounding said first strewing disk and radially outwardly spaced therefrom having an inwardly tapering outlet means defining an opening for feeding said mixture to a second rotary strewing disk; said second rotary strewing disk rotatably mounted about said vertical axis and positioned below said first strewing disk; said housing further comprising a second hopper casing means surrounding said second strewing disk and radially outwardly spaced therefrom and having a larger diameter than said first hopper casing means, said second strewing disk connected to said drive means for rotation with said basket, said second hopper casing means having inwardly tapering outlet means which in combination with the top of said cylindrial basket defines an entrance gap for enabling said particle mixture to feed into said classifying chamber; a plurality of rotary dipsersing blades rotatably mounted about said vertical axis adjacent said entrance gap, said dispersing blades connected to said drive means for rotation with said basket; and wherein said guide vanes include first and second guide vanes positioned axially adjacent each other and said first and second guide vanes are angularly adjustable relative to one another.

* * * * *